United States Patent [19]

Novinsky

[11] Patent Number: 4,940,441

[45] Date of Patent: Jul. 10, 1990

[54] AERODYNAMIC FLYING DISC WITH WEIGHTED INSERT

[76] Inventor: Steven Novinsky, 30 Hamilton Ave., Fairview, N.J. 07022

[21] Appl. No.: 425,245

[22] Filed: Oct. 23, 1989

[51] Int. Cl.[5] ..... A63H 27/12; A63B 65/10

[52] U.S. Cl. ..... 446/46; 446/48; 273/424

[58] Field of Search ..... 446/46, 47, 48, 43; 40/324, 325; 273/424, 425, 428

[56] References Cited

U.S. PATENT DOCUMENTS

| | | | |
|---|---|---|---|
| 3,738,053 | 6/1973 | Camorota | 446/43 X |
| 4,030,472 | 6/1977 | Watkins | 446/46 X |
| 4,176,843 | 12/1979 | DeWitt, Jr. | 446/46 |
| 4,212,131 | 6/1980 | Ross, Jr. | 446/48 |
| 4,254,575 | 3/1981 | Gould | 446/46 |
| 4,262,911 | 4/1981 | Opresik et al. | 273/425 X |
| 4,301,616 | 11/1981 | Gudgel | 446/48 X |
| 4,351,129 | 9/1982 | Kerkenbush et al. | 446/46 |
| 4,503,635 | 3/1985 | Harrington | 446/46 |
| 4,515,570 | 5/1985 | Beltran | 446/47 |
| 4,516,946 | 5/1985 | Rodarte | 446/46 |
| 4,681,553 | 7/1987 | Rodarte | 446/46 |

FOREIGN PATENT DOCUMENTS

| | | | |
|---|---|---|---|
| 950892 | 10/1949 | France | 40/324 |
| 542325 | 8/1941 | United Kingdom | 40/324 |

*Primary Examiner*—Robert A. Hafer
*Assistant Examiner*—D. Neal Muir
*Attorney, Agent, or Firm*—Arnold D. Litt

[57] ABSTRACT

This invention provides an improved aerodynamic disc comprising a central portion and a perimeter portion, the perimeter portion defining a central cavity situated within the central rim portion, in which upper and lower openings are connected by a threaded circular sidewall. The central portion of the disc contains a rotatably removable insert which is threadably engaged with the threaded circular sidewall of the central cavity. The insert comprises upper and lower circular surfaces which are connected by a threaded circular sidewall. The threading of the central cavity sidewall of the disc and the circular sidewall of the insert, are in male/-female relationship to one another. Accordingly, by inserting and rotating the insert in the central cavity, the threads become engaged thereby locking the insert into the central cavity. Conversely, the insert may be rotated in the opposite direction, thereby removing it from the cavity. Imprinting and/or embossing of words, designs logos or the like on the insert can be readily achieved.

16 Claims, 2 Drawing Sheets

AERODYNAMIC FLYING DISC WITH WEIGHTED INSERT

BACKGROUND OF THE INVENTION

1. FIELD OF THE INVENTION

This invention relates to a throwing disc of the kind commonly referred to as a flying saucer.

Aerodynamic flying discs have been used widely in the past.

For example, see U.S. Pat. No. 4,212,131 and patent cited therein.

In general, the appearance of a flying disc comprises an inverted saucer-shaped body comprising a thin-walled disc-like object comprising a central portion bounded about its perimeter by an annular rim portion whose outer perimeter curls downward to form a lip about the perimeter of the disc. The central rim portion and lip are shaped to provide an aerodynamic profile whereby when the disc is flung through the air with a spinning motion, it sails or glides. In the prior art, these aerodynamic discs are usually manufactured by injection molding in one piece from plastic. The difficulty with this process is its inability to imprint or emboss the central portion of the disc with lettering, logos or other decorative indicia which many users find desirable.

In U.S. Pat. No. 4,176,843 a two piece flying disc is disclosed wherein an insert may be inserted into and removed from the central portion of the disc. The inventor discloses the placing of lettering and/or embossing on the face of the disc. However, this prior art disc has a number of serious deficiencies which renders it undesirable. The insert is secured to the body of the disc by snapping it into a shallow recess on the underside of the disc whereby a flange protrusion on the insert fits into the shallow recess on the disc thereby locking it in place. It has been found that in especially turbulent wind, the insert can become partially or totally disengaged from the disc thereby interfering with its superior flight characteristics.

2. SUMMARY OF THE INVENTION

This invention provides an improved aerodynamic disc which avoids the deficiencies of prior art discs and which possesses high quality flight characteristics.

According to the invention, the flying disc comprises two sections: a central portion and a perimeter portion. The perimeter portion defines a central cavity situated within the central rim portion, in which upper and lower openings are connected by a threaded circular sidewall. The perimeter portion of the annular rim curls downward to form a lip about the circumference of the disc and provides the disc with additional aerodynamic stability.

The central portion of the disc comprises a rotatably removable insert which is threadably engaged with the threaded circular sidewall of the central cavity. The insert comprises an upper and lower circular surface, the diameters of which are slightly smaller than the corresponding openings of the central cavity, thereby permitting it to easily but snugly fit into the central cavity. The surfaces of the insert are connected by a threaded circular sidewall having a height substantially identical to that of the central cavity. The threading of the central cavity sidewall, of the disc, on the one hand, and the circular sidewall of the insert, on the other hand, are in male/female relationship to one another. Accordingly, by inserting and rotating the insert in the central cavity, the threads become engaged thereby locking in and securing the insert within the central cavity. Conversely, by rotating the insert in the opposite direction, it can easily be removed from the cavity.

Imprinting and/or embossing of words, designs, logos or the like on the insert can be readily achieved.

This invention cures the defects existent in prior art discs such as described in U.S. Pat. No. 4,176,843 in that the insert is more securely fixed or lock into the frame of the disc, giving the disc a more stable aerodynamic flight motion, while giving the user the flexibility of quickly and easily changing words, designs and logos affixed to the surface of the insert.

DESCRIPTION OF THE PREFERRED EMBODIMENT

Figure 1:
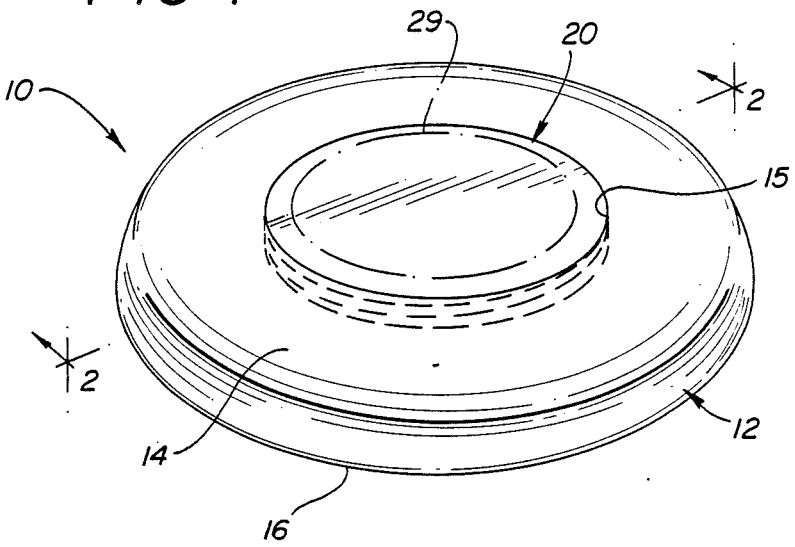
FIG. 1 is a perspective view of the flying disc according to the invention.
Figure 2:
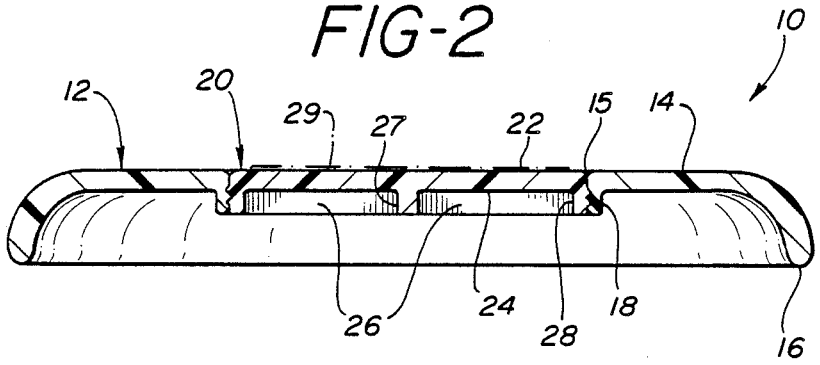
FIG. 2 is a cross-sectional view of the disc of FIG. 1 taken along cut line 2—2.

With reference to FIGS. 1 and 2, the flying disc 12 is depicted, comprising a central portion 21 containing a removable insert 20 and a perimeter portion 17. The perimeter portion defines a central cavity or opening 15 in which the insert 20 is situated.

The insert comprises an upper surface 22 and a lower surface 24 which are connected by a threaded circular sidewall 18. The perimeter portion of the disc curls downward to form a lip 16 about the rim of the disc.

Figure 3:
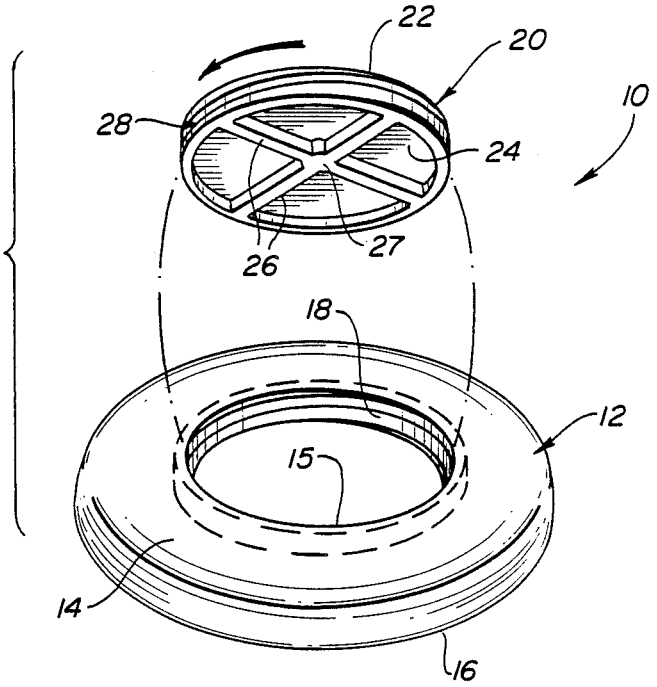
FIG. 3 is an exploded perspective view of the disc of FIG. 1.

In FIG. 3, the exploded view shows the removable insert 20, the main portion of the disc 12 comprising the perimeter portion and the central cavity or opening 15. The insert comprises upper and lower circular surfaces 20 and 24 whose diameters are slightly smaller than the corresponding openings of the central cavity to facilitate easy insertion and/or removal therein. The upper and lower surfaces are connected by a threaded outer wall 28 having a height substantially identical to that of the central cavity. Gripping means 26 are provided on lower surface of the disc so that a user can easily insert the disc or remove it, as the case may be, from the central cavity. The disc is locked into the cavity by rotating it so that the threads on the outer wall of the insert, mesh with the threads on the circular sidewall of the central cavity; conversely, rotating the disc in the opposite direction, disengages the threads and permits easy removal of the disc.

Figure 4:
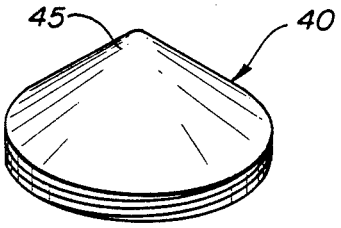
FIG. 4 is a perspective view of an alternate embodiment of the insert.
Figure 5:
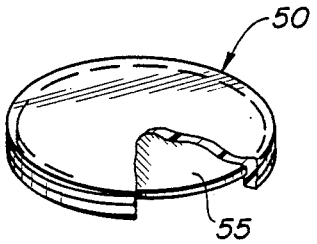
FIG. 5 is a perspective view of an alternate embodiment of the insert.
Figure 6:
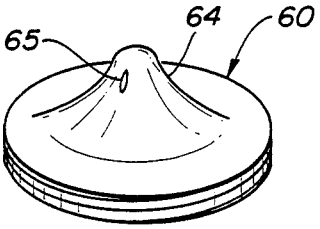
FIG. 6 is a perspective view of an alternate embodiment of the insert.
Figure 7:
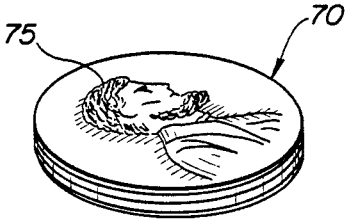
FIG. 7 is a perspective view of an alternate embodiment of the insert.

FIGS. 4, 5, 6 and 7 show different embodiments of the invention that can be utilized in connection with the insert. The logos, drawings or diagrams may be situated on the surface of the disc such as shown in FIG. 7; may be raised above the surface such as shown in FIGS. 4 (conical) and 6; or may be situated entirely within the insert as shown in FIG. 5.

More specifically, FIG. 5 shows a partial view of the insert 50, wherein a removable circular metal plate 55 may be situated, held in place by a circumferential groove 52 that runs along the inner surface of the circular sidewall of the insert. In this alternate embodiment, different weighted plates can be inserted or removed to compensate for wind factors and to provide for fine tuning of the flight of the disc through the air. Depending upon the weight of the metal plate 55, shorter, longer, straight or sinusoidal flight paths can be achieved.

Another alternative embodiment is shown in FIG. 6 wherein openings 65 are provided to create a whistling sound as air rushes through the holes during the flight of the disc. Not only does this provide an aesthetically pleasing sound to the user, but also permits the disc to be easily located in the air by animals who are trained to catch the disc with their teeth.

With respect to FIG. 7, another alternative embodiment comprises a sculpture or image which may be flat or three dimensional on the surface of the insert.

The actual imprinting or embossing of words, designs, images, sculptures and the like on the surface of the insert may be done in any of the well known processes set forth in the prior art including but not limited to injection molding, if the insert is made from a plastic material, lamination or adhesive. Plastic materials can comprise such compounds as polyvinylchloride, polyethylene, polypropylene, and the like. The plastic compositions can incorporate various of the conventional compounding agents to alter the physical properties of the plastic material, as desired, e.g., density, flexibility, hardness etc. Coloring agents can be included to provide any suitable color, or combination thereof.

It is desirable that the disc be relatively light weight. The weight for any particular disc will depend in part on its particular size i.e. diameter, its construction and the nature of the various logos which are situated on or within the central cavity insert.

In another embodiment of the invention the various logos etc. can be constructed with a material impregnated with a fluorescent dye so that they glow in the dark increasing night time visibility. Alternatively, the insert material can be translucent so as to permit light to shine through it from a small light bulb powered by a small battery that can be mounted to the lower surface of the insert.

As many different embodiments of this invention will now occur to those skilled in the art, it is to be understood that the specific embodiments of the invention as presented herein is intended by way of illustration only and not as limitations on the invention, but that the limitations thereon should be determined only from the appended claims.

Having set forth the invention, what is claimed is:

1. An aerodynamic flying disc comprising:

a thin-walled annular rim containing central and perimeter portions, wherein the perimeter portion defines a central cavity situated within the central rim portion, in which upper and lower openings are connected by a threaded circular sidewall, the perimeter portion of said annular rim curling downwardly to form a circumferential lip about the rim; and a rotatably removable insert, threadably engaged within the central cavity, comprising upper and lower circular surfaces whose diameters are slightly smaller than the corresponding openings of the central cavity, and which are connected by a threaded circular sidewall, the height of which is substantially identical to the height of the central cavity, whereby the insert may be rotatably removed from the central cavity by rotating it about its axis thereby threadably disengaging it from said central cavity, and wherein the insert bears indicia, and wherein the circular sidewall of the insert comprises an inner surface along which runs a circumferential groove and within which is situated a removable circular plate, said plate having a chosen weight.

2. The insert of claim 1 wherein openings are provided on the surface of the insert thereby allowing air to rush through said openings during the flight of the aerodynamic flying disc whereby a whistling sound is created.

3. The insert of claim 1 wherein a substantially three (3) dimensional image is situated on the upper surface of the insert.

4. The insert of claim 1 wherein a substantially flat image is situated on the upper surface of the insert.

5. The insert of claim 1 wherein at least a portion of said insert is constructed of a material impregnated with a fluorescent dye thereby permitting it to glow in the dark.

6. The insert of claim 1 wherein the surface of the insert is substantially conical.

7. The insert of claim 1 wherein gripping means are provided on the lower circular surface thereof.

8. The insert of claim 1 comprising a translucent material and wherein a light bulb powered by a battery is mounted by way of mounting means to the lower surface of the insert.

9. A thin-walled annular rim containing central and perimeter portions, wherein the perimeter portion defines a central cavity situated within the central rim portion, in which upper and lower openings are connected by a threaded circular sidewall, the perimeter portion of said annular rim curling downwardly to form a circumferential lip about the rim; and a rotatably removable insert, threadably engaged within the central cavity, comprising upper and lower circular surfaces whose diameters are slightly smaller than the corresponding openings of the central cavity, and which are connected by a threaded circular sidewall, the height of which is substantially identical to the height of the central cavity, whereby the insert may be rotatably removed from the central cavity by rotating it about its axis thereby threadably disengaging it from said central cavity, and wherein the insert bears indicia, and wherein the circular sidewall of the insert comprises an inner surface along which runs a circumferential groove and within which is situated a removable circular metal plate.

10. The insert of claim 9 wherein openings are provided on the surface of the insert thereby allowing air to rush through said openings during the flight of the aerodynamic flying disc whereby a whistling sound is created.

11. The insert of claim 9 wherein a substantially three (3) dimensional image is situated on the upper surface of the insert.

12. The insert of claim 9 wherein a substantially flat image is situated on the upper surface of the insert.

13. The insert of claim 9 wherein at least a portion of said insert is constructed of a material impregnated with a fluorescent dye thereby permitting it to glow in the dark.

14. The insert of claim 9 wherein the surface of the insert is substantially conical.

15. The insert of claim 9 wherein gripping means are provided on the lower circular surface thereof.

16. A thin-walled annular rim containing central and perimeter portions, wherein the perimeter portion defines a central cavity situated within the central rim portion, in which upper and lower openings are connected by a threaded circular sidewall, the perimeter portion of said annular rim curling downwardly to form a circumferential lip about the rim; and a rotatably removable insert, threadably engaged within the central cavity, comprising upper and lower circular surfaces whose diameters are slightly smaller than the corresponding openings of the central cavity, and which are connected by a threaded circular sidewall, the height of which is substantially identical to the height of the central cavity, whereby the insert may be rotatably removed from the central cavity by rotating it about its axis thereby threadably disengaging it from said central cavity, and wherein the insert bears indicia, and wherein the circular sidewall of the insert comprises an inner surface along which runs a circumferential groove and within which is situated a removable circular metal plate wherein the circular metal plate may be replaced with another circular metal plate of different weight whereby the flight path of the aerodynamic flying disc may be altered.

* * * * *

UNITED STATES PATENT AND TRADEMARK OFFICE

CERTIFICATE OF CORRECTION

PATENT NO. : 4,940,441

DATED : July 10, 1990

INVENTOR(S) : Steven Novinsky

It is certified that error appears in the above-identified patent and that said Letters Patent is hereby corrected as shown below:

At Column 2, Line 33, reference is made to a "central portion" of the disc which is labelled therein as "21". "21" should read --29--.

At Column 2, Line 34, reference is made to a "perimeter portion 17". should read --perimeter portion 14--.

At Column 2, Lines 38-40, reference is made to Fig. 1 and a "threaded circular sidewall 18". should read "threaded circular sidewall 28 (see Fig. 3)".

At Column 3, Line 2, reference is made to a "groove 52 that runs along the inner surface of the circular sidewall of the insert". The label "52" was omitted from Fig. 5 and should be added with the arrow pointing to the inner surface of the circular sidewall of the insert.

Signed and Sealed this

Eighth Day of October, 1991

*Attest:*

HARRY F. MANBECK, JR.

*Attesting Officer*

*Commissioner of Patents and Trademarks*